US006412905B1

(12) United States Patent
Lin

(10) Patent No.: US 6,412,905 B1
(45) Date of Patent: Jul. 2, 2002

(54) INK JET CAP WITH VENT

(75) Inventor: Tsung-Te Lin, San-Chung (TW)

(73) Assignee: Acer Communications and Multimedia, Taoyuan (TW)

( * ) Notice: Subject to any disclaimer, the term of this patent is extended or adjusted under 35 U.S.C. 154(b) by 0 days.

(21) Appl. No.: 09/740,894

(22) Filed: Dec. 21, 2000

(51) Int. Cl.[7] ..... B41J 2/165
(52) U.S. Cl. ..... 347/29; 347/32
(58) Field of Search ..... 347/22, 29, 32

(56) References Cited

U.S. PATENT DOCUMENTS 5,847,728 A * 12/1998 Lee ..... 347/29
5,992,967 A * 11/1999 Nguyen et al. ..... 347/32
6,068,364 A * 5/2000 Kusumi et al. ..... 347/29
6,283,576 B1 * 9/2001 Premnath et al. ..... 347/29

* cited by examiner

*Primary Examiner*—Huan Tran
(74) *Attorney, Agent, or Firm*—Winston Hsu

(57) ABSTRACT

A capping system has a cap for capping an ink jet print head, and a supporting structure for mechanically engaging and disengaging the cap with the ink jet print head. The cap has a vent. When the supporting structure engages the cap with the ink jet print head, the cap covers the ink jet print head to cap the ink jet print head. The vent in the cap ensures that the pressure inside the volume of the cap equalizes with the pressure outside the volume of the cap. This prevents overpressure within the cap.

16 Claims, 6 Drawing Sheets

INK JET CAP WITH VENT

BACKGROUND OF THE INVENTION

1. Field of the Invention

The present invention relates to an ink jet service station. More specifically, the present invention discloses an ink jet cap in an ink jet service station.

2. Description of the Prior Art

Ink jet printing systems are found in a variety of faxes, printers, photostats and other types of office equipment. To ensure the continuous proper operation of an ink jet print head within the ink jet printing system, the ink jet printing system has an ink jet service station. The ink jet service station performs basic head cleaning and capping functions. Prior to printing, and at periodic intervals during a printing session, the ink jet print head is wiped clean to ensure its performance. A wiper in the ink jet service station performs this wiping function. The ink jet print head is capped when the printing system is not in use. An ink jet capping system performs this capping function within the ink jet service station.

An ink jet print head comprises a plurality of nozzles. These nozzles spray the ink onto a media, such as paper, to perform the printing operation. The ink jet print head is capped during periods of inactivity to prevent the ink inside these nozzles from drying out, which would otherwise clog the nozzles. Within the nozzles are heating elements. These heating elements heat the ink prior to it being jetted onto the media. This heating operation reduces the viscosity of the ink, and is also responsible for the actual jetting of the ink.

To cap the ink jet print head, the ink jet print head enters the ink jet service station and the cap, which is generally just an open-ended box of rubber, is lifted up to the ink jet print head. The lips of the cap seal quite readily with the ink jet print head, and overpressure develops within the cap as the mouth of the cap is pressed onto the ink jet print head. This overpressure results in backflow of the ink within the nozzles. Consequently, the heating elements within the nozzles have no ink upon which to act when a printing operation begins. This causes the heating elements to overheat, which can lead to damage to the nozzles.

SUMMARY OF THE INVENTION

It is therefore a primary objective of this invention to provide a capping system for an ink jet service station that prevents overpressure within the cap when capping the ink jet print head.

The capping system, briefly summarized, is used to cap an ink jet print head, and has a cap for capping the ink jet print head, and a supporting structure for mechanically engaging or disengaging the cap with the ink jet print head. The cap has a vent. When the supporting structure engages the cap with the ink jet print head, the cap covers the ink jet print head to cap the ink jet print head. The vent in the cap ensures that the pressure inside the volume of the cap equalizes with the pressure outside the volume of the cap. This prevents overpressure within the cap.

It is an advantage of the present invention that by preventing overpressure within the cap when capping the ink jet print head, the present invention prevents backflow of ink within the nozzles of the ink jet print head. Consequently, the heating elements within the nozzles do not overheat for lack of ink, and the useful lifetime of the ink jet print head is thus extended.

This and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
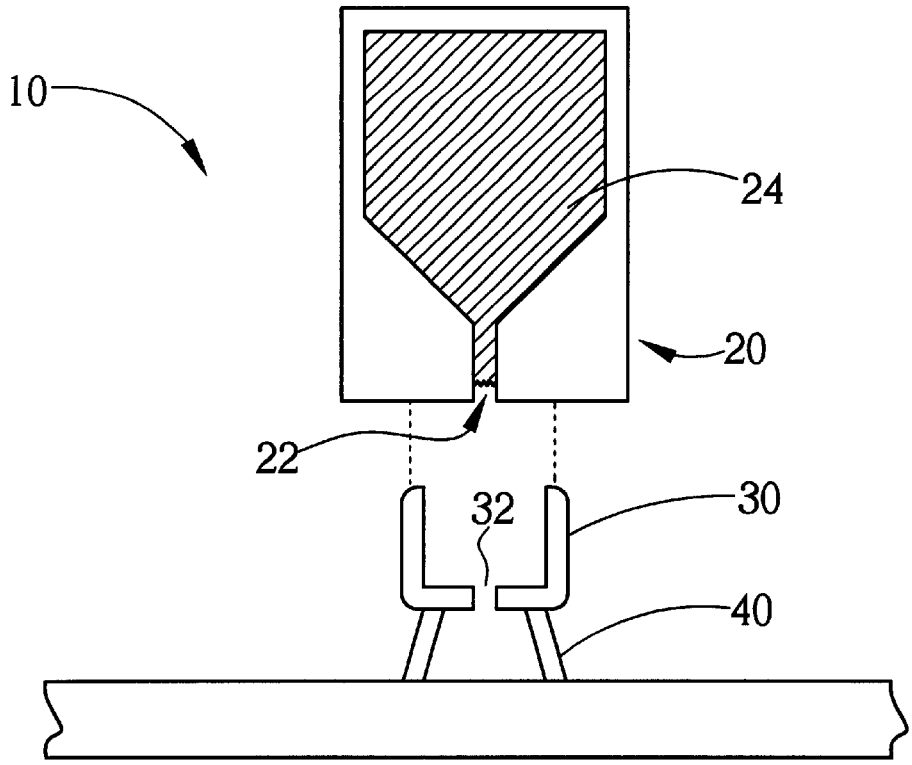
FIG. 1 to FIG. 3 are simplified side-view sequence diagrams of a capping operation of the present invention.
Figure 2:
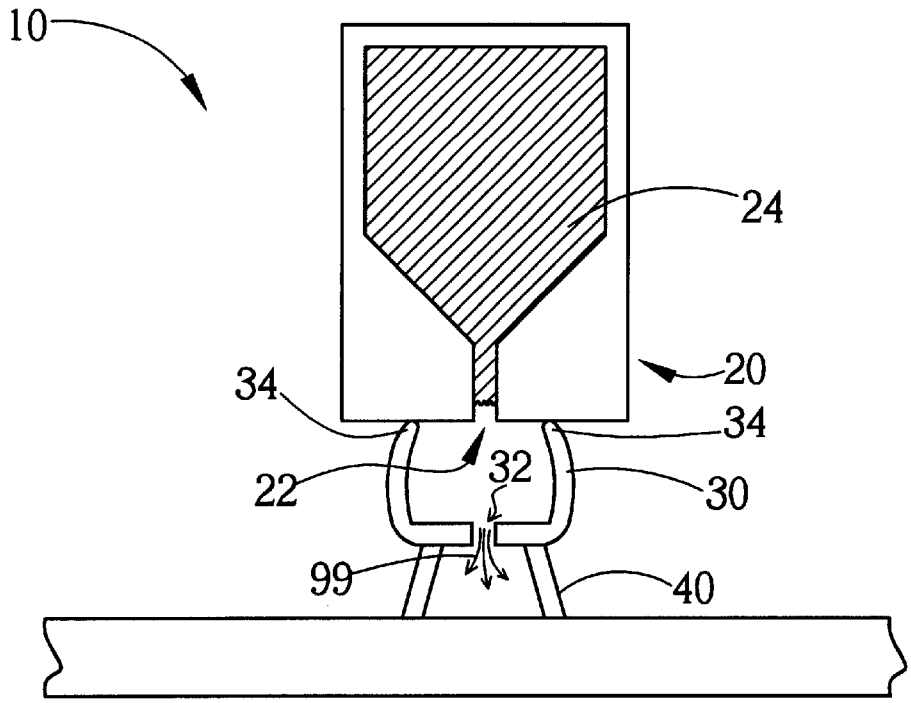
Figure 3:
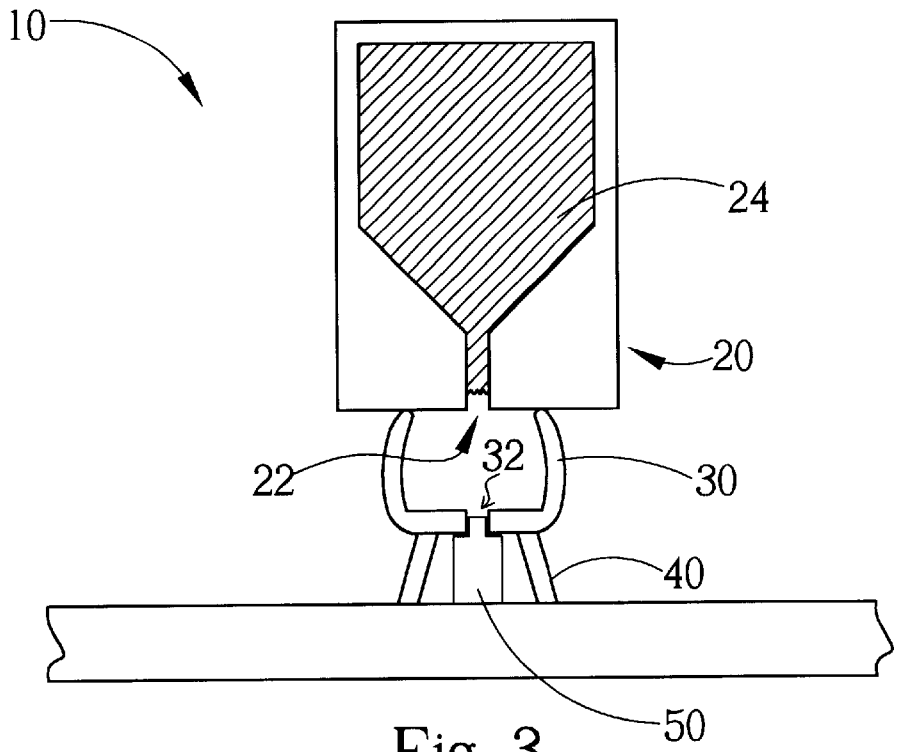

Please refer to FIG. 1 to FIG. 3. FIG. 1 to FIG. 3 are simplified side-view sequence diagrams of the capping operation of the present invention, a capping system 10. These diagrams are meant only to illustrate the capping operation of the present invention, and are not intended to depict the actual structure of the capping system 10, which will be disclosed in detail later. In FIG. 1, an ink jet print head 20 is in a position waiting to be capped. The ink jet print head 20 has at least one nozzle 22, and ink 24. The nozzle 22 sprays the ink 24 onto a document (not shown) to perform a printing operation with the document. The ink 24 is within the volume of the nozzle 22. A cap 30 of the capping system 10 will perform the capping function, and is supported by a supporting structure 40. The cap 30 is simply an open-ended box, and is made of a flexible material, such as rubber. The cap 30 has a vent hole 32 in its structure, which acts as a vent. The supporting structure 40 engages and disengages the cap with the ink jet print head 20. That is, the supporting structure 40 uses the cap 30 to cap and uncap the ink jet print head 20.

In FIG. 2, the supporting structure 40 has lifted the cap 30 up to the ink jet print head 20, engaging the cap 30 with the ink jet print head 20 to perform the capping operation. Lips 34 of the cap 30 readily seal with the bottom of the ink jet print head 20 so that the cap 30 covers the ink jet print head 20. The supporting structure 40 firmly presses the cap 30 against the ink jet print head 20. This, due to the flexible nature of the cap 30, will cause the volume inside the cap 30 to be slightly reduced. Normally, such a reduction in volume would cause overpressure inside the cap 30. The vent hole 32, however, permits air inside the volume of the cap 30 to escape outside, as indicated by the arrows 99. Similarly, air outside the volume of the cap 30 could flow into the volume of the cap 30 through the vent hole 32. In this manner, the pressure inside the volume of the cap 30 equalizes with the pressure outside the volume of the cap 30 . Hence, due to the vent hole 32, acting as a vent, no overpressure develops inside the cap 30 and so there is no backflow of ink 24 within the nozzle 22. Consequently, the ink 24 remains within the nozzle 22.

Because air can freely flow into and out of the cap 30 through the vent hole 32, the cap 30 would not suitably perform the capping and sealing operations of the ink jet print head 20 if the vent hole 32 were left open. Hence, the capping system 10 provides for a plug 50, as show in FIG.

3. After the cap 30 is firmly seated onto the in je[009f] print head 20, th[0085] plug 50 closes the vent hole 32 so that air can neither enter nor leave the volume of the cap 30 through the vent hole 32. Consequently, the ink 24 will not dry out in the nozzle 22 due to the vent hole 32 in the cap 30. The vent hole 32, in conjunction with the plug 50, together act as a vent that can be opened to permit the free flow of air into and out of the cap 30, and which can be closed to fully seal the cap 30. When the plug 50 does not plug the vent hole 32, the vent is open. When the plug 50 plugs the vent hole 32, the vent is closed.

Figure 4:
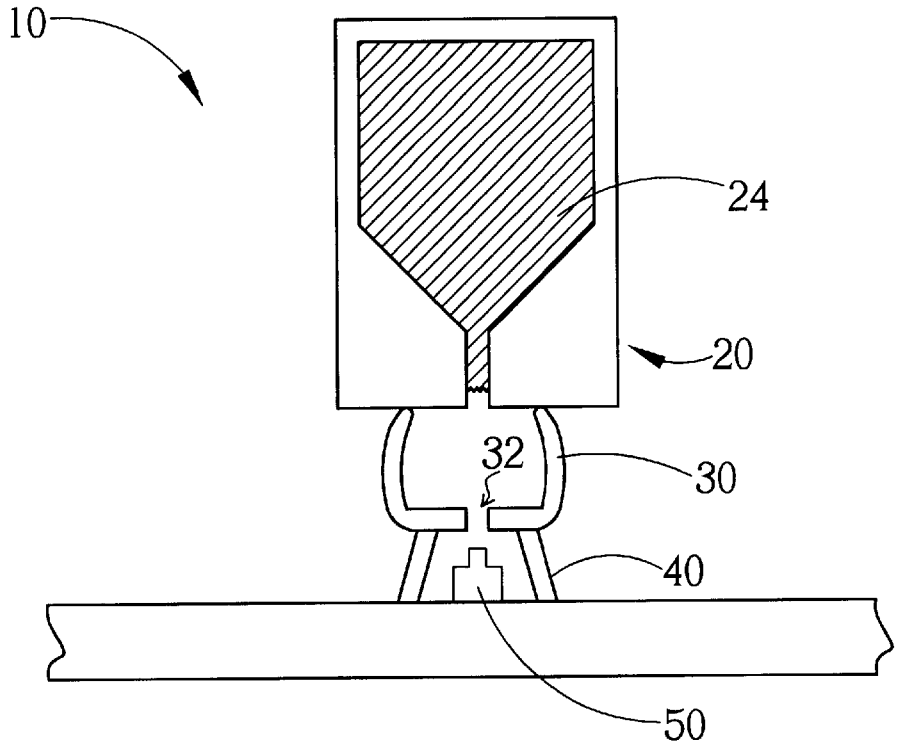
FIG. 4 and FIG. 5 are simplified side-view sequence diagrams of a capping system of the present invention uncapping an ink jet print head.
Figure 5:
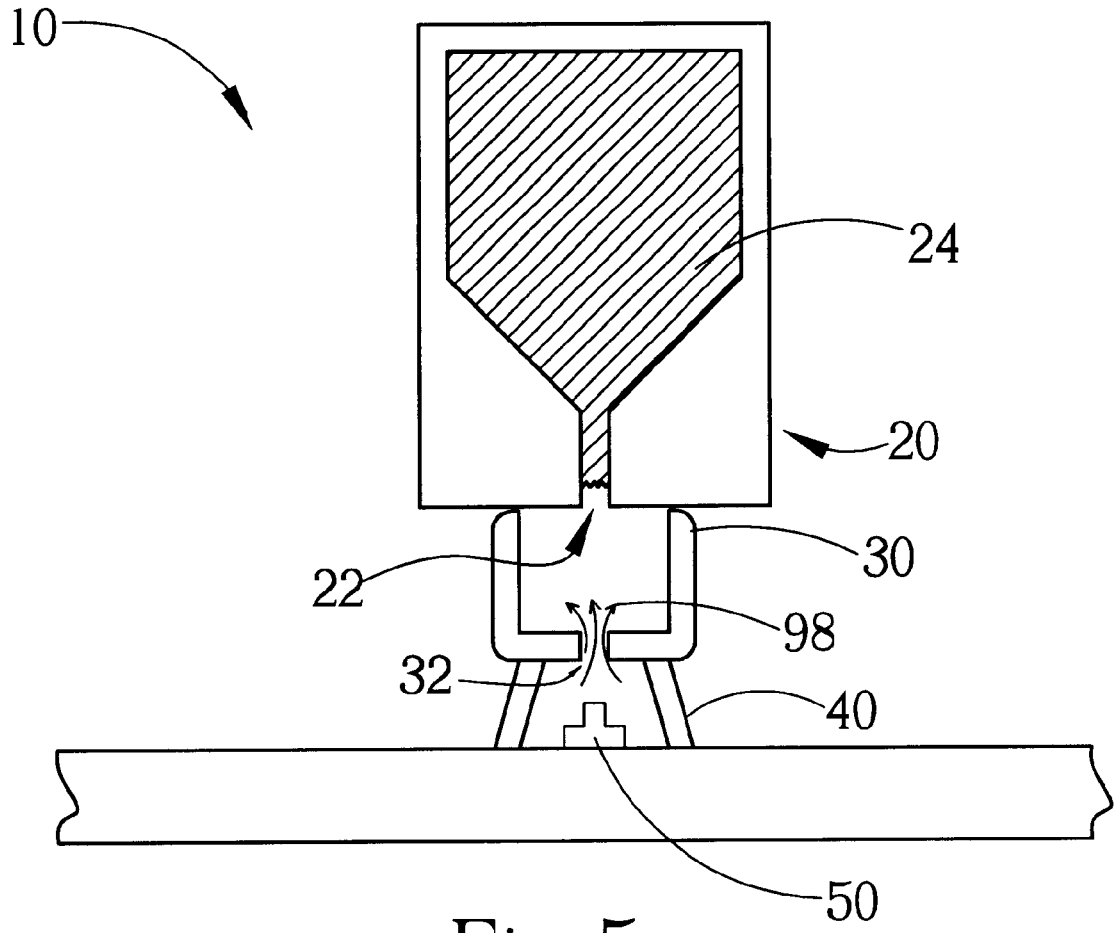

Please refer to FIG. 4 and FIG. 5. FIG. 4 and FIG. 5 are sequence diagrams of the capping system 10 uncapping the ink jet print head 20. As shown in FIG. 4, before the supporting structure 40 disengages the cap 30 from the ink jet print head 20 to uncap the ink jet print head 20, the plug 50 first unplugs the vent hole 32. The vent is thus open. As the supporting structure 40 pulls the cap 30 away from the ink jet print head 20, the volume of the cap 30 slightly expands as the cap 30 is relieved of the squeezing pressure imparted to it by the ink jet print head 20 and the supporting structure 40. This volume expansion is shown in FIG[00ab] 5. Normally, such an expansion of the volume of the cap 30 would lead to a corresponding drop in pressure inside the cap 30. This pressure drop would tend to draw the ink 24 out of the nozzle 22. However, with the vent now open, air is free to enter into and exit from the volume of the cap 30 through the vent hole 32, as indicated by the arrows 98. Thus, the pressure within the volume of the cap 30 equalizes with the pressure outside the volume of the cap 30.

Figure 6:
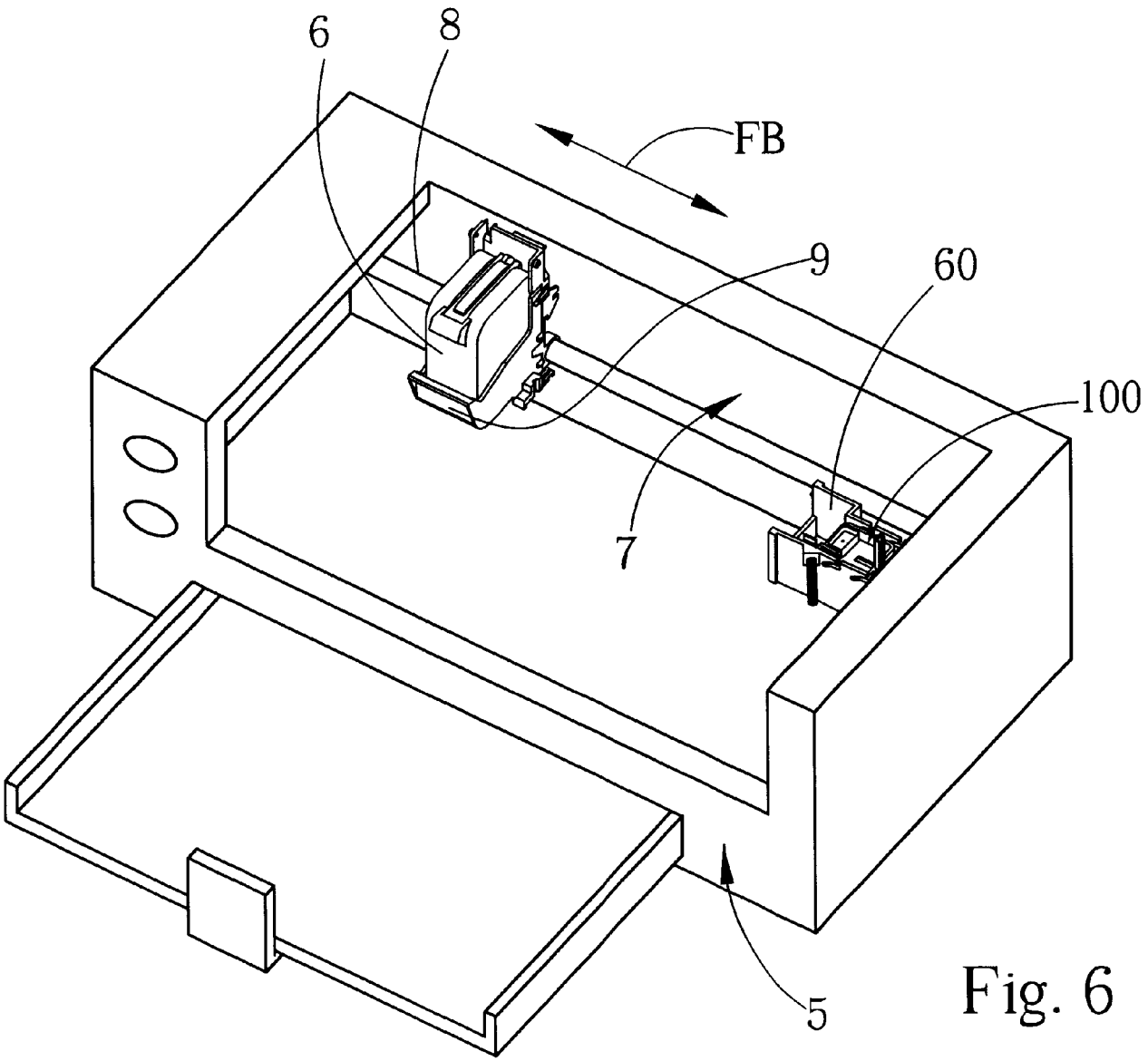
FIG. 6 is a perspective view of a preferred embodiment capping system installed in a present invention ink jet service station that is in a printing device.
Figure 7:
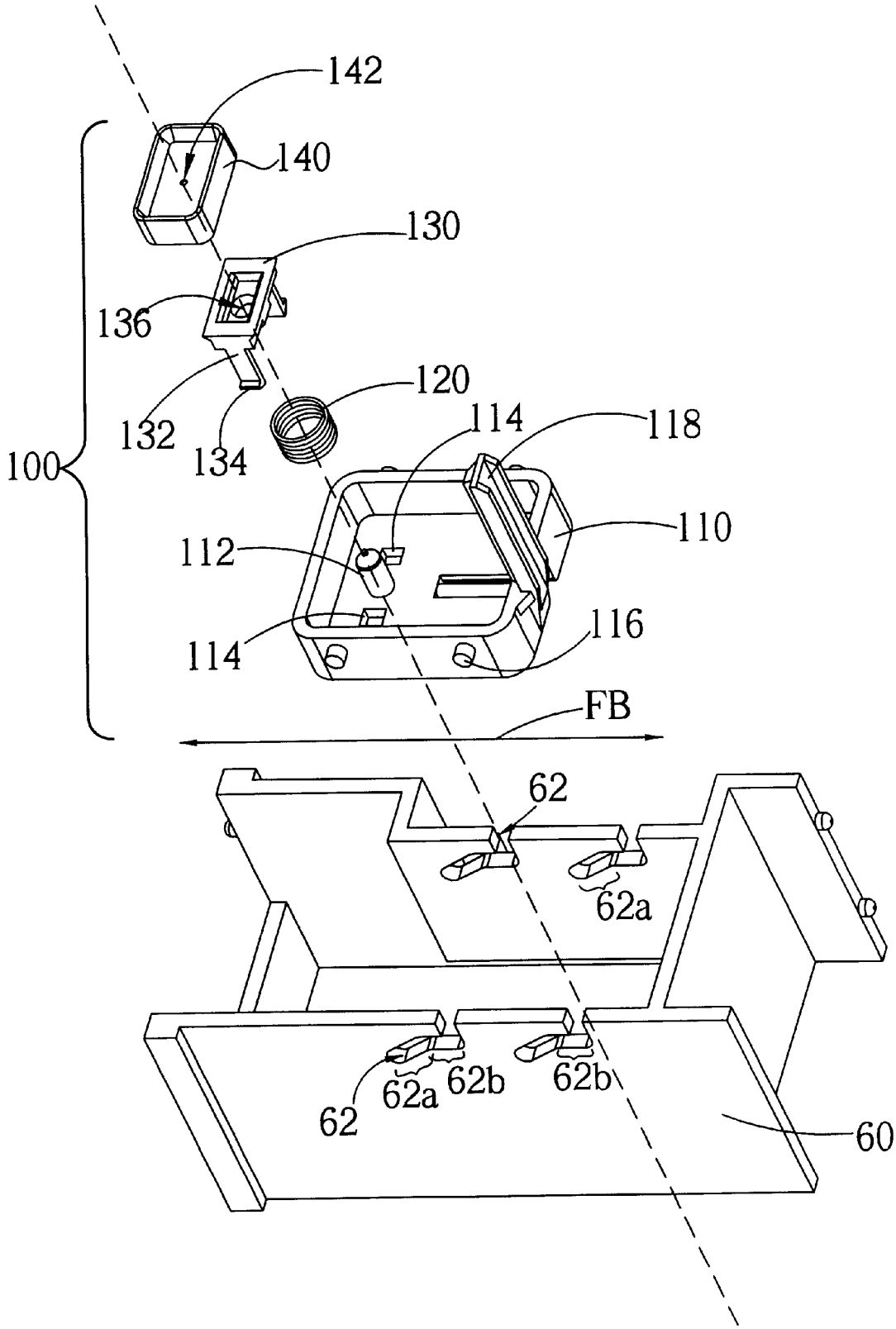
FIG. 7 is an exploded view diagram of the ink jet service station of FIG. 6.

Please refer to FIG. 6 and FIG. 7. FIG. 6 is a perspective view of a preferred embodiment capping system 100 installed in a present invention ink jet service station 60 that is in a printing device 5. FIG. 7 is an exploded view diagram of the ink jet service station 60 with the capping system 100. The exact function of the printing device 5 is not relevant to the present invention, and may be any device that uses ink jet printing technology. Although only the present invention capping system 100 is disclosed within the ink jet service station 60, in fact the service station 60 would also perform other functions as well, such as wiping of the ink jet print head. For simplicity, these other functions are not shown in the present invention diagrams, nor are they discussed any further in this detailed description of the preferred embodiment.

A carrier 9 is mechanically connected to a driving device 8 that moves the carrier 9 forward and backward along a print track 7. This forward and backward movement is indicated by arrow FB. Installed in the carrier 9 is an ink jet cartridge 6. The ink jet cartridge 6 holds the ink (not shown) required for printing, and on its underside has an ink jet print head (not shown) that performs the actual printing operation as the cartridge 6 is moved forward and backward by the carrier 9. As disclosed above, the ink jet print head has at least one nozzle that jets the ink onto a document (not shown) to perform the printing operation. The ink jet service station 60 uses the capping system 100 to cap the ink jet print head in the manner disclosed above.

The ink jet service station 60 is mounted at an end of the print track 7. In order to perform the capping operation, the carrier 9 moves in a forward direction and brings the ink jet cartridge 6 into the ink jet service station 60. Once inside the ink jet service station 60, the carrier 9 moves forward and engages with the capping system 100 to perform the capping operation. When the carrier 9 moves backwards out of the ink jet service station 60, the interaction of the carrier 9 with the capping system 100 causes the capping system 100 to uncap the ink jet print head.

The capping system 100 comprises a base 110, a spring 120, a mount 130 and a cap 140. The base 110 comprises a plug 112 that is fixed to the base 110, mounting holes 114, pins 116 and a contact 118. The spring 120 is disposed around the plug 112 and elastically supports the mount 130. The mount 130 has legs 132 that slide within the mounting holes 114 of the base 110, and a pass-through hole 136 through which the plug 112 may pass. The spring 120 pushes upward on the mount 130. Each leg 132 of the mount 130 has a barb 134 that prevents each of the legs 132 from leaving their respective mounting holes 114. The cap 140 is affixed to the top of the mount 130, and has a vent hole 142. The cap 140 can be made of any suitable material that enables the cap 140 to properly cap the ink jet print head. In the preferred embodiment, the cap 140 is made of rubber. The vent hole 142 in the cap 140 is disposed over the plug 112. Hence, when the cap 140 is pressed down, the elastic support of the spring 120 will yield to the downward force exerted on the cap 140. The cap 140 and mount 130 will together move down towards the plug 112. Pushed down sufficiently far, the plug 112 will pass through the pass-through hole 136 in the mount 130 and plug the vent hole 142 of the cap 140. Together, the plug 112 and the vent hole 142 form a vent for the cap 140. As described above, when the plug 112 stops the vent hole 142, the vent is closed, and when the plug 112 is free of the vent hole 142, the vent is open.

The base 110 is slidably disposed within the ink jet service station 60. The ink jet service station 60 has a plurality of slots 62. Together, these slots 62 form a base track upon which the base 110 slides. Each pin 116 of the base 110 slots into a corresponding slot track 62 of the service station 60. These pins 116 slide within their respective slots 62. Each slot track 62 has a first track **62*a* and a second track 62*b*. The first track 62*a* is diagonal to both the forward-backward direction FB and to the vertical motion of the cap. As the base 110 slides forward along the direction FB in the first track 62*a*, the base 110 is lifted up. Consequently, forward movement of the base 110 along the first track 62*a* tends to bring the cap 140 towards the ink jet print head. Conversely, backward movement of the base 110 along the first track 62*a* tends to pull the cap 140 away from the ink jet print head. The second track 62*b* lies essentially parallel to the direction of the print track 7, i.e., the direction FB. That is, the second track 62*b* is perpendicular to the vertical movement of the cap 140, and so movement of the base 110 along the second track 62*b* does not tend to change the distance between the cap 140** and the ink jet print head.

Figure 10:
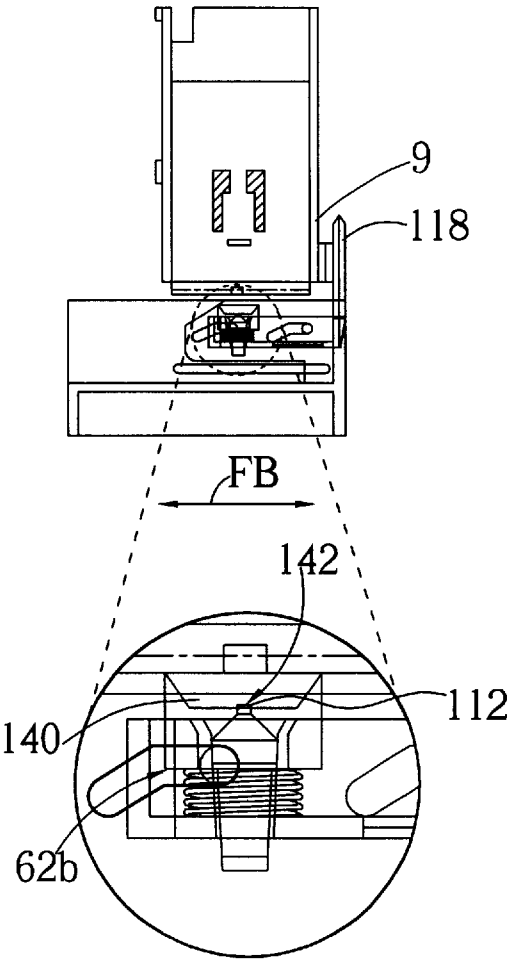
FIG. 8 to FIG. 10 are side view sequence diagrams of the capping operation of a present invention capping system.
Figure 9:
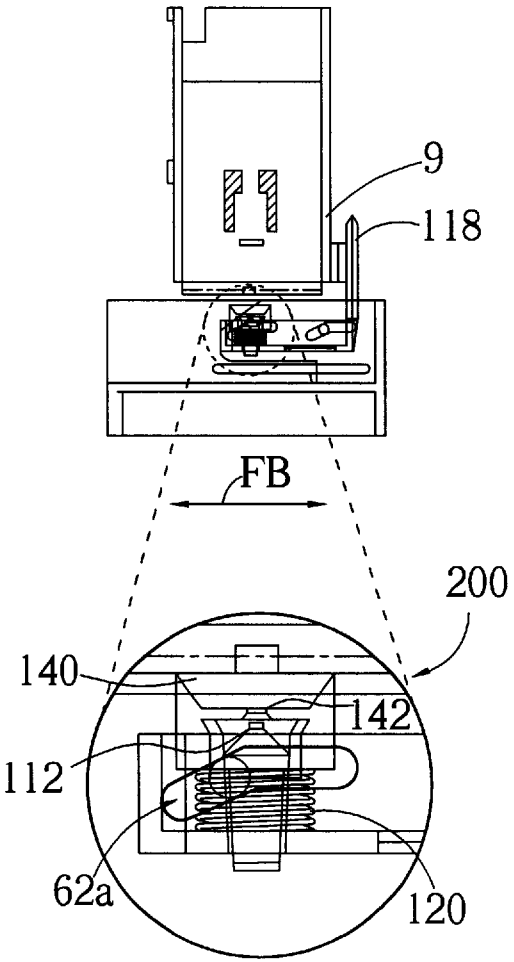
Figure 8:
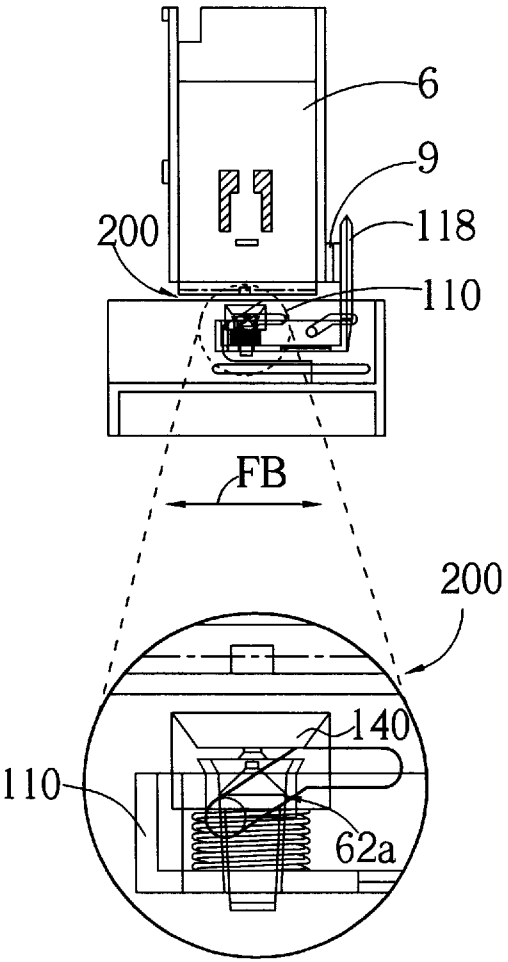

Please refer to FIG. 8 to FIG. 10, in conjunction with FIG. 7. FIG. 8 to FIG. 10 are side view sequence diagrams of the capping operation of the present invention capping system 100. As shown in FIG. 8, the carriage 9 moves forward in the ink jet service station 60, carrying with it the ink jet cartridge 6. On the underside of the ink jet cartridge 6 is an ink jet print head 200. As the carriage 9 moves forward, it engages with the contact 118 on the base 110. Consequently, the carriage 9 pushes the base 110 forward along the direction FB. The base 110 is in the first track **62*a*, and so forward movement tends to raise the print cap 140 towards the print head 200**.

In FIG. 9, the forward movement of the base 110, as driven by the carriage 9, has lifted the base 110, and the cap 140 with it, up towards the ink jet print head 200. The cap 140 contacts the ink jet print head 200, capping the ink jet print head 200. As the vent hole 142 is unplugged, air is free to escape the cap 140 so as to ensure that the pressure inside the cap 140 is equalized with the pressure outside the cap 140. As the base 110 continues to move forward along track 62*a*, and thus up towards the ink jet print head 200, the cap 140 is squeezed between the base 110 and the ink jet print head 200. Under this pressure, the spring 120 yields and compresses. The plug 112 thus moves through the mount 130 towards the vent hole 142.

As shown in FIG. 10, the continual pushing forward along the direction FB by the carriage 9 on the contact 118 has moved the base 110 into the second track 62*b*. The cap 140 has capped the ink jet print head 200, and the plug 112 has stopped the vent hole 142, closing the vent. Thus, the plug 140 is fully sealed against the ink jet print head 200, and the pressure within the cap 140 is equalized with the pressure outside the cap 140.

As should be clear from the diagrams, the uncapping operation of the capping system 100 would perform in exactly the reverse order of the capping operation. That is, by moving backwards along the direction FB, the base 110 would leave the second track 62*b* and enter the first track 62*a*. In 62*a*, the plug 112 would first separate from the vent hole 142 as the spring 120 extended, and then the cap 140 would disengage from the ink jet print head 200. The impetus for the backward movement of the base 110 could derive from a spring that is disposed in the ink jet service station 60 and connected to the base 110 in such a manner as to tend to pull the base 110 backward, i.e., elastically loading the base 110 so that the base 110 always tends to pull backwards along the direction FB. Alternatively, the carriage 9 could engage with the contact 118 in such a way as to pull the base 110 backwards as the carriage 9 leaves the ink jet service station 60. The preferred embodiment 100 utilizes a spring, which is not shown in the diagrams, to elastically load the base 110 within the ink jet service station 60.

In contrast to the prior art, the present invention uses a combination of both a vent hole and a plug to form a vent in the cap of the capping system. The vent is opened in the initial stages of the capping operation to ensure that the pressure within the cap remains equalized with external air pressure. The final stage of the capping operation uses the plug to plug the vent hole to close the vent so that a good seal is ensured by the cap. Additionally, the capping system of the present invention uses the driving power of the ink jet carriage to provide the mechanical energy needed to perform the capping operation. Hence, no additional motors are needed to perform the capping operation.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A capping system for an ink jet service station, the capping system being used to cap an ink jet print head, the capping system comprising:

a cap for capping the ink jet print head, the cap having a vent hole for permitting the passage of air into and out of the volume of the cap to prevent overpressure inside the volume of the cap; and a supporting structure for mechanically engaging or disengaging the cap with the ink jet print head, the supporting structure comprising:

a base disposed within the ink jet service station, a plug mounted on the base, the plug for plugging the vent hole; and;

a mount movably disposed over the plug, the cap fixed onto the mount;

wherein when the supporting structure engages the cap with the ink jet print head, the cap first covers the ink jet print head to cap the ink jet print head, the vent hole ensuring that the pressure inside the volume of the cap equalizes with the pressure outside the volume of the cap, and then the interaction of the mount with the base causes the plug to plug the vent hole to prevent air from outside the volume of the cap from entering inside the volume of the cap via the vent hole.

2. The capping system of claim 1 wherein the ink jet print head comprises:

ink for printing; and a nozzle for jetting the ink onto a document to perform the printing operation;

wherein by preventing the overpressure, the vent hole prevents backflow of the ink within the nozzle due to overpressure.

3. The capping system of claim 1 wherein the plug unplugs the vent hole prior to the disengaging of the cap from the ink jet print head so that air may pass into and out of the volume of the cap via the vent hole.

4. The capping system of claim 3 wherein the mount is elastically supported in a vertically movable manner over the plug, the mount comprising a pass-through hole through which the plug may pass; wherein the base and the ink jet print head move towards each other so that the cap caps the ink jet print head, and the ink jet print head depresses downward on the cap, causing the mount to move down towards the plug, and the plug passes through the pass-through hole of the mount to plug the vent hole of the cap.

5. The capping system of claim 4 wherein the base is movably disposed within the ink jet service station, and the movement of the base within the ink jet service station causes the base to move towards the ink jet print head to engage the cap with the ink jet print head, or moves the base away from the ink jet print head to disengage the cap from the ink jet print head.

6. The capping system of claim 5 wherein the ink jet service station comprises a base track for directing the movement of the base within the ink jet service station, and the base is slidably mounted on the base track.

7. The capping system of claim 6 wherein the ink jet print head is mounted on a carriage that moves in a forward and backward direction along a print track, the ink jet service station mounted at one end of the print track, and the base comprises a contact for engaging with the carriage; wherein the carriage pushes on the contact to move the base forward along the base track to engage the cap with the ink jet print head, and the base moves backwards along the base track to disengage the cap from the ink jet print head.

8. The capping system of claim 7 wherein the base track comprises a first track that is diagonal to the vertical direction, and a second track that is essentially perpendicular to the vertical direction; wherein when the base moves forward or backward along the first track, the cap respectively engages or disengages with the ink jet print head, and when the base is in the second track the ink jet print head is capped by the cap and the vent hole in the cap is plugged by the plug.

9. A printing device with a capping system, an ink jet service station, a carrier, a driving device for driving the carrier along a print track, the carrier being used to hold an ink jet cartridge, the capping system being used for the ink jet service station to cap an ink jet print head of the ink jet cartridge, the capping system comprising:

a cap for capping the ink jet print head, the cap having a vent hole for permitting the passage of air into and out of the volume of the cap to prevent overpressure inside the volume of the cap; and a supporting structure for mechanically engaging and disengaging the cap with the ink jet print head, the supporting structure comprising:

a base disposed within the ink jet service station, a plug mounted on the base, the plug for plugging the vent hole; and;

a mount movably disposed over the plug, the cap fixed onto the mount;

wherein when the supporting structure engages the cap with the ink jet print head, the cap first covers the ink jet print head to cap the ink jet print head, the vent hole ensuring that the pressure inside the volume of the cap equalizes with the pressure outside the volume of the cap, and then the interaction of the mount with the base causes the plug to plug the vent hole to prevent air from outside the volume of the cap from entering inside the volume of the cap via the vent hole.

10. The printing device of claim 9 wherein the ink jet print head comprises:

ink for printing; and a nozzle for jetting the ink onto a document to perform the printing operation;

wherein by preventing the overpressure, the vent hole prevents backflow of the ink within the nozzle due to overpressure.

11. The printing device of claim 10 wherein the plug unplugs the vent hole prior to the disengaging of the cap from the ink jet print head so that air may pass into and out of the volume of the cap via the vent hole.

12. The printing device of claim 11 wherein the mount is elastically supported in a vertically movable manner over the plug, the mount comprising a pass-through hole through which the plug may pass; wherein the base and the ink jet print head move towards each other so that the cap caps the ink jet print head, and the ink jet print head depresses downward on the cap, causing the mount to move down towards the plug, and the plug passes through the pass-through hole of the mount to plug the vent hole of the cap.

13. The printing device of claim 12 wherein the base is movably disposed within the ink jet service station, and the movement of the base within the ink jet service station causes the base to move towards the ink jet print head to engage the cap with the ink jet print head, or moves the base away from the ink jet print head to disengage the cap from the ink jet print head.

14. The printing device of claim 13 wherein the ink jet service station comprises a base track for directing the movement of the base within the ink jet service station, and the base is slidably mounted on the base track.

15. The printing device of claim 14 wherein the ink jet print head moves in a forward and backward direction along the print track, the ink jet service station is mounted at one end of the print track, and the base comprises a contact for engaging with the carriage; wherein the carriage pushes on the contact to move the base forward along the base track to engage the cap with the ink jet print head, and the base moves backwards along the base track to disengage the cap from the ink jet print head.

16. The printing device of claim 15 wherein the base track comprises a first track that is diagonal to the vertical direction, and a second track that is essentially perpendicular to the vertical direction; wherein when the base moves forward or backward along the first track, the cap respectively engages or disengages with the ink jet print head, and when the base is in the second track the ink jet print head is capped by the cap and the vent hole in the cap is plugged by the plug.

* * * * *